US005971043A

United States Patent [19]

Aldrich

[11] Patent Number: 5,971,043

[45] Date of Patent: Oct. 26, 1999

[54] MULTI-CHAMBERED BOOTH AND METHOD FOR FILLING DRUMS

[75] Inventor: Mark D. Aldrich, Westminster, Colo.

[73] Assignee: Delta Deluxe, L.L.C. (D/B/A/ Delta Chemical Services), Deer Park, Tex.

[21] Appl. No.: 09/075,564

[22] Filed: May 11, 1998

[51] Int. Cl.[6] ..... B67C 3/26

[52] U.S. Cl. ..... 141/270; 141/2; 141/18; 141/93; 141/129; 141/97; 141/181; 141/284; 53/167

[58] Field of Search ..... 141/2, 18, 29, 141/65, 67, 93, 97, 129, 168, 181, 263, 284, 311 R, 270; 53/167, 89, 90, 281, 282, 425, 426

[56] References Cited

U.S. PATENT DOCUMENTS 4,124,045 11/1978 Slywka ..... 141/129
4,297,827 11/1981 Allison ..... 53/282
5,001,878 3/1991 Sanfilippo et al. ..... 53/510
5,067,529 11/1991 Gonzalez-Miller et al. ..... 141/7
5,398,481 3/1995 Takeuchi et al. ..... 53/432

*Primary Examiner*—Henry J. Recla
*Assistant Examiner*—Timothy L. Maust
*Attorney, Agent, or Firm*—Duane, Morris & Heckscher LLP

[57] ABSTRACT

An apparatus and method for filling drums with a substance. First and second external chambers are employed, and an interior filling chamber is employed, which is adjacent to the first and second external chambers. A first exterior door is provided between the first external chamber and an outside environment, a second exterior door is provided between the second external chamber and the outside environment, a first interior door is provided between the first external chamber and the filling chamber, and a second interior door is provided between the second external chamber and the filling chamber. The filling chamber fills a drum with the substance and vents out of the filling chamber gaseous emissions produced during said filling.

19 Claims, 3 Drawing Sheets

MULTI-CHAMBERED BOOTH AND METHOD FOR FILLING DRUMS

BACKGROUND OF THE INVENTION

1. Field of the Invention

The present invention relates to apparatuses and methods for filling a drum with a fluid.

2. Description of the Related Art

There is often a need to fill containers with a compound such as a fluid or other substance. For example, systems are typically employed to fill containers with a fluid, such as a chemical or petrochemical type solution. Cylindrical containers called drums are typically used for this purpose. Drums may be of various capacities or sizes. For example, some drums hold a "barrel" (42 gallons) of liquid, or other quantities such as 55 gallons. So-called "tighthead drums" contain an opening for filling at the top, sometimes called a "bunghole." "Open head" drums, on the other hand, which do not have a bunghole, are also sometimes employed.

Drums are typically filled by moving them through a "booth," which contains filling equipment. There are typically three general stages involved in filling a drum: orientation, filling, and capping. Referring now to FIG. 1, there is shown a prior art drum filling system 100 which illustrates these stages. System 100 comprises orientation stage 110, filling stage 120, and capping stage 130, as well as linear conveyor 103 and filling booth 127. Booth 127 contains blower (or blowers) 135, lance 134, and inlet (ingress) and outlet (egress) doors 121, 122, respectively. A tighthead drum 101, having bunghole 102, is typically "indexed," or moved, through the three stages 110, 120, 130 on conveyor belt 103. In orientation station or stage 110, drum 101 is oriented, typically by a device called an "orientator." This device may be automated, and typically spins the drum until bunghole 102 is properly positioned for filling in the next stage, filling station or stage 120. (For open head drums, orientation stage 110 may be skipped, or it may be used to spin the drum for jet-coding or other purposes.)

Drum 101 is then indexed by conveyor 103 to filling stage 120, i.e. to the inside of booth 127. Inlet door 121 opens on the incoming side of filling both 127, to allow the now-oriented drum 101 to be indexed into the booth, so that lance 134 can be lowered into bunghole 102 to fill drum 101 with a given fluid. (Sometimes the orientator and thus orientation stage 110 is also positioned within booth 127, in which case booth door 121 is opened to allow drum 101 to be indexed into the booth to be oriented and filled.)

Booth 127 is employed at filling stage 120 so that a blower 135 (such as centrifugal blower) can capture vapor, fumes, or other gaseous emissions that escape during the filling process. Blower 135 can then appropriately process these emissions, depending upon their nature and the nature of the liquid which fills drum 101, for example by using vents, scrubbers, or an incinerator.

After filling in filling stage 120, drum 101 is indexed by conveyor 103 out of booth 127, to capping station or stage 130. Outlet door 122 on the outgoing side of booth 127 typically opens in conjunction with this indexing, to allow the drum out of the booth. At the capping stage 130, a manual (human) or automatic operator caps bunghole 102 so as to seal the drum. (For open head drums, the capping stage involves applying an entire top "lid" to the drum instead of simply capping a bunghole.)

One problem involved with such conventional drum-filling systems and methods is that when the inlet and outlet doors to the filling booth open, the air flow of blower 135 changes greatly. For example, when inlet door 121 opens to allow drum 101 to be indexed into booth 127, blower 135 must all of a sudden draw a much greater volume of air out of the booth, due to the changed air pressure in the booth caused by opening the door to the external environment, in order to ensure that vapors in the booth are still evacuated from the booth by the blower. Thus, blower 135 needs to be much larger and more expensive than if doors 121 and 122 were always closed, since the blower needs to be able to handle the maximum amount of air flow that can occur during the three-stage filling cycle.

Other equipment such as scrubbers or incinerators may also require more capacity to handle the maximum blower output.

Additionally, a heavier-duty blower is needed not only because the maximum volume is so high, but because of the very large change in gas flow volume to be handled.

SUMMARY

An apparatus for filling drums with a substance. First and second external chambers are employed, and an interior filling chamber is employed, which is adjacent to the first and second external chambers. A first exterior door is provided between the first external chamber and an outside environment, a second exterior door is provided between the second external chamber and the outside environment, a first interior door is provided between the first external chamber and the filling chamber, and a second interior door is provided between the second external chamber and the filling chamber. The filling chamber fills a drum with the substance and vents out of the filling chamber gaseous emissions produced during said filling.

DESCRIPTION OF THE PREFERRED EMBODIMENT

The present invention addresses the above-noted problems and deficiencies of conventional techniques by using a multi-chambered booth having three separate chambers or compartments, one for each of the three stages of the filling process, in which the doors to the chambers are sequenced such that an "interior" door (i.e. a door of the filling chamber, which contains the blower intake) is opened only when an "exterior" door is closed. Further details and advantages of the present invention are described in further detail below.

Figure 1:
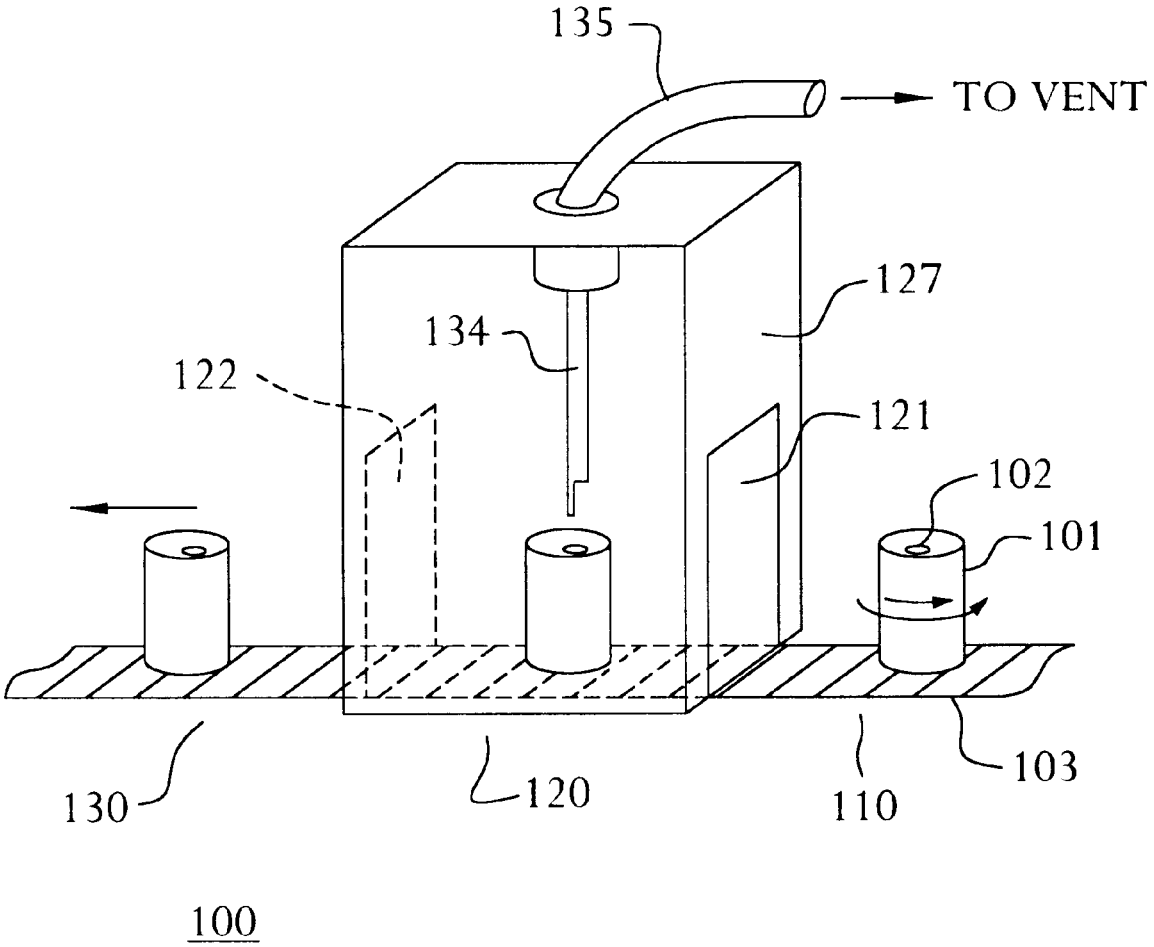
FIG. 1 PRIOR ART
FIG. 1 is a schematic diagram of a prior art drum filling system which illustrates the orientation, filling, and capping stages involved in filling a drum with a substance.
Figure 2:
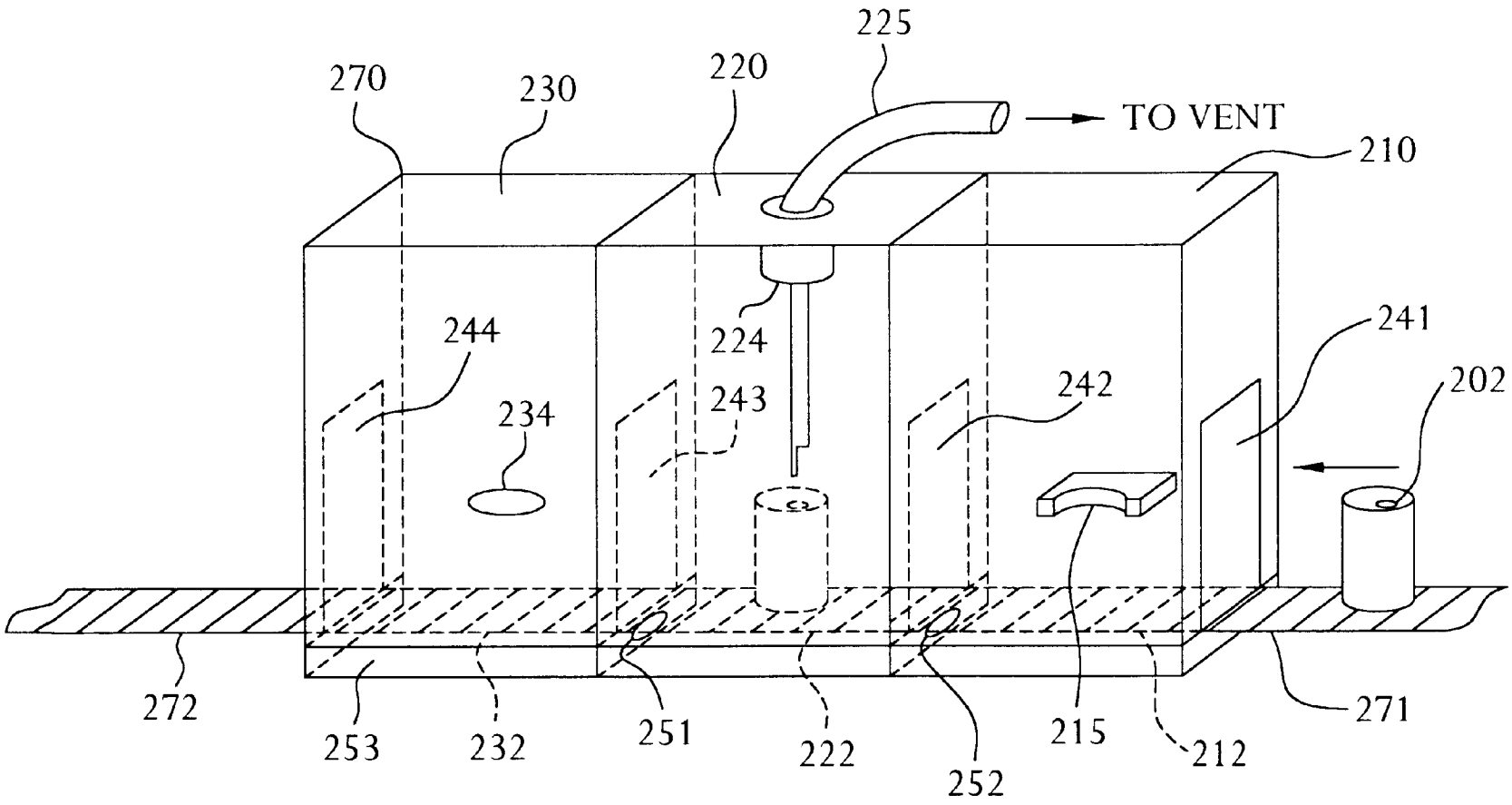
FIG. 2 is a schematic diagram of a drum filling system, in accordance with an embodiment of the present invention.

Referring now to FIG. 2, there is shown a schematic diagram of a drum filling system 200, in accordance with an embodiment of the present invention. System 200 comprises booth 270, which has orientation chamber 210, filling chamber 220, and capping chamber 230. System 200 also comprises conveyors 212, 222, 232, 271, and 272. Booth 270 comprises automatic vertical sliding doors 241, 242, 243, and 244, as well as louvers 251 and 252, and raised flooring 253. Orientation chamber 210 comprises orientator 215. Filling chamber 220 comprises lance 224 and blower 225, and capping chamber 230 comprises a small, manual opening 234, to permit a person to insert his hands in order to manually cap the drum. (Alternatively, capping 230 may comprise automatic capping equipment.) Lance 224 typically operates by being lowered into bunghole 202 of a properly oriented drum. Next, liquid is emitted from the bottom tip of the lance, and the lance is gradually raised as the liquid level inside the drum rises, such that the tip of the lance is just below the rising surface of the liquid in the drum. During this filling process, various vapors and fumes typically are produced inside filling chamber 220, which are vented away by blower 225, and sent to vents, scrubbers, incinerators, or other emission processors.

As will be understood, door 241 is the inlet door for orientation chamber 210, door 242 is the outlet door for orientation chamber 210 as well as the inlet door for filling chamber 220, door 243 is the outlet door for filling chamber 220 as well as the inlet door for capping chamber 230, and door 244 is the outlet door for capping chamber 230.

As will be appreciated, when its respective inlet and outlet doors are closed, the air pressure inside a chamber is substantially isolated or sealed off from that of adjacent chambers or the outside environment. For example, there is substantial air (and thus air pressure) communication between orientation chamber 210 and filling chamber 220 when door 242 is open. However, when door 242 is closed, this communication is a substantially limited and small amount, which relatively small amount of air pressure communication may be adjusted by use of louver 252.

Doors 242, 243 may be referred to as "interior" doors of the booth, since they allow (or prevent) air and air pressure communication between chambers. Similarly, doors 241 and 244 may be referred to as exterior doors, since they allow (or prevent) air and air pressure communication between a chamber and the outside, external environment. Orientation chamber 210 and capping chamber 230 may be referred to as exterior chambers, since they have a door opening directly to the outside, or exterior, and filling chamber 220 may be referred to as an interior chamber, since its doors open only to other chambers.

Thus, in system 200, there is direct communication between filling chamber 220 (and hence blower 225) and the external environment only when doors 241 and 242 are open; or when doors 243 and 244 are open, i.e., only when both inlet and outlet doors of an exterior chamber are open. Otherwise, if for example, door 242 is open but door 241 is closed, then there is substantial air pressure communication between filling chamber 220 and orientation chamber 210, but this does not expose filling chamber 220 to the exterior because door 241 is closed.

In system 200 of the present invention, the opening and closing of doors 241, 242, 243, and 244 are sequenced to ensure that there is never direct, substantial air pressure communication between the interior filling chamber and the external environment. In particular, this is accomplished by ensuring that at least one of the inlet and outlet doors of each exterior chamber is closed at all times, i.e. both inlet and outlet doors for orientation chamber 210 may never be open at the same time and both inlet and outlet doors for capping chamber 230 may never be open at the same time. This may be accomplished, in a preferred embodiment, by appropriate sequencing of the opening of doors 241, 242, 243, and 244, as described in further detail below.

Door 241 is an inlet door for orientation chamber 210, to allow orientation chamber 210 to receive empty drums to be oriented. Door 242 allows oriented, empty drums to be indexed out of orientation chamber 210 and into filling chamber 220. Door 243 allows filled drums to be indexed out of filling chamber 220 and into capping chamber 230. Door 244 is an outlet door for capping chamber 230, which allows filled and capped drums to be delivered out of capping chamber 230 and the entire booth 270.

In an embodiment of the present invention, the indexing of conveyors 212, 222, 232, 271, 272, and opening and closing of doors 241, 242, 243, 244 are sequenced such that whenever an interior door (242, 243) is open, the exterior door of the adjoining chamber is not open. For example, when door 241 opens to receive a new drum, door 242 is always closed. Similarly, when door 244 opens to emit a capped and filled drum, door 243 is closed. In one preferred embodiment, drums are cycled through the chambers of booth 270 in pipeline fashion, so that while one drum is being capped, another is being filled, and still another is being oriented.

Figure 3:
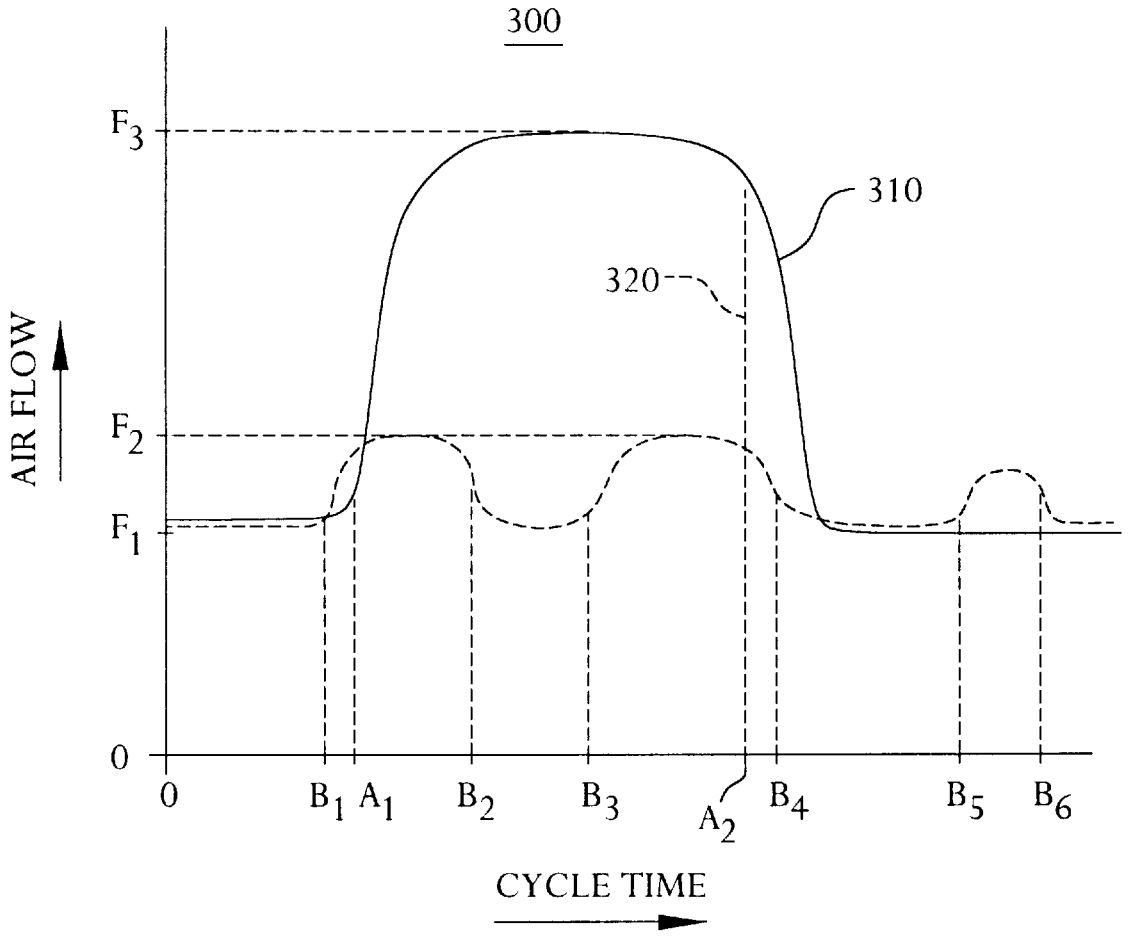
FIG. 3 is a graph illustrating the relative performance of the drum filling system of the present invention and a prior art drum filling system.

Referring now to FIG. 3, there is shown a graph 300 illustrating the relative performance of the drum filling system 200 of the present invention and a prior art drum filling system 100. Graph 300 (not necessarily drawn to scale) illustrates air flow on the vertical axis relative to stages of the drum filling cycle, on the horizontal axis. Solid line 310 illustrates the air flow (and thus blower) requirements of prior art drum filling system 100, and dashed line 320 illustrates the air flow (and thus blower) requirements of drum filling system 200 of the present invention, with reference to a complete filling cycle. With reference to prior art system 100, prior to time $A_1$, both doors 121, 122 are closed. Air flow is thus relatively low, at flow $F_1$. Next, at time $A_1$, doors 121 and 122 open to index a filled drum out of booth 127 and to index a new, empty drum into booth 127. As doors 121 and 122 open, the air flow of blower 135 increases dramatically, since booth 127 and hence blower 135 is now in substantially direct communication with the outside environment. Thus, blower 135 (and associated emissions processing equipment) needs to be large and heavy duty enough to be able to handle a maximum air flow of $F_3$. Further, the large change $\Delta F$ ($F_3$–$F_1$) in air flow imposes further requirements on blower 135 and emissions processing equipment. Doors 121 and 122 then close at time $A_1$, reducing air flow once more to $F_1$.

With respect to drum filling system 200 of the present invention, the initial air flow drawn by blower 235, when all doors are closed, is similar to that of system 100, i.e. $F_1$. However, during a complete filling cycle, the air flow never rises above a maximum $F_2$. At the first stage of the cycle, at time $B_1$, exterior door 244 opens, to deliver the most recently capped, filled drum from capping chamber 230. During this phase, doors 243, 242, and 241 are closed, and the drum is indexed out of capping chamber 230 by conveyors 272, 232. During this phase, air flow rises only slightly, since there is only limited communication between capping chamber 230 and filling chamber 220 (e.g., due to louver 251). Next, at time $B_2$, exterior door 244 closes, and capping chamber 230 is temporarily empty of a drum. Air flow begins to fall again to the floor level of $F_1$.

Next, at time $B_3$, interior doors 243, 242 open, and conveyors 232, 222, and 212 index a recently-filled drum from filling chamber 220 to capping chamber 230, and index a recently-oriented drum from orientation chamber 210 to filling chamber 220. Because capping chamber 230 is at this point substantially isolated or sealed off from the environment outside booth 270 (because door 244 is closed and the manual capping opening 234 is not very large), and orientation chamber 210 is also substantially isolated from the outside environment, there is not any substantial communication between filling chamber 220 and the outside environment when interior doors 242, 243 are open. Thus, air flow rises only slightly, to approximately $F_2$, at this point, instead of to $F_3$ as in the prior art. Further, since exterior doors 241 and 244 are closed at this point in the filling cycle when interior doors 242, 242 are open, the change in air flow $\Delta F$ ($F_2$–$F_1$) is not as great as it would be if the orientation stage were open to the outside environment, as in the prior art (i.e., ($F_3$–$F_1$)).

Doors 243 and 242 then close at time $B_4$, and capping and filling of these two drums, respectively, commences. Air flow again begins to fall back down to floor level $F_1$. Finally, door 241 opens, at time $B_5$, conveyors 271 and 212 index a new drum into orientation chamber 210, and air flow rises slightly, because of the effective increase in air volume seen by blower 235. Door 241 then closes at time $B_6$, and air flow once again begins to drop back down to $F_1$. Thus, at no point during the drum filling cycle is there substantial air pressure communication between filling chamber 220 and the outside environment. The present invention, therefore, advantageously allows much smaller, more efficient, and cheaper blowers and associated processing equipment (e.g. scrubbers or incinerators) to be employed than are required in the prior art, since the maximum air flow to be handled as well as the maximum changes in air flow, are reduced.

Therefore, the present invention comprises a multi-chambered drum-filling booth 270, in which the doors to chambers 210, 220, 230 are sequenced such that an interior door (i.e. a door of the filling chamber, which contains the blower intake) is opened only when an exterior door is closed. Thus, drums can be indexed into and out of booth 270 through exterior doors 241, 244, respectively, only when an interior door 242, 243 is not simultaneously open. This can be assured by the appropriate door and conveyor sequencing of drums through the three chambers/stages, as explained above.

In alternative embodiments, a system such as system 200 may be configured to index multiple drums through the booth at a time. For example, two drums may be sent through the filling cycle simultaneously, in which case each chamber has two sets of equipment (e.g., orientation stage 210 has two orientators). Additionally, different numbers of independent conveyors may be employed in alternative embodiments.

In another alternative embodiment, orientation chamber 210 comprises a small manual opening instead of an automatic orientator, to permit a person to insert his hands in order to manually orient the drum.

In another alternative embodiment, chambers 210 and 230 are employed without necessarily comprising orientation and capping means, respectively. For example, orientation may be either not employed or employed outside booth 270. In this alternative embodiment filling chamber 220 is still sandwiched in between two exterior chambers, whether or not these exterior chambers serve any purpose other than isolating filling chamber 220 from the external environment during indexing of a drum into our out of the filling chamber. For example, in one alternative embodiment, filling chamber 220 may comprise both filling and orientation stages, but chamber 210 is still used, as a wait stage. In this alternative embodiment, the orientation stage may consist of automatic orientation apparatus, or orientation may be performed manually. In the latter case, a "glove box" type opening may be used instead of a completely open opening, to prevent the human operator from being exposed to fumes produced inside filling chamber 220, and also to prevent air pressure communication between filling chamber 220 and the external environment. When chamber 210 is used as a "wait stage," and orientation is either not performed or performed before the wait stage or inside filling chamber 220, chamber 230 may still be used as a capping chamber; alternatively, chamber 230 may be used as a second wait stage with capping performed elsewhere or not at all.

As described above, booth 270 comprises automatic vertical sliding doors 241, 242, 243, and 244. As will be appreciated by those skilled in the art, in alternative embodiments, different types of doors may be employed. For example, instead of vertical sliding doors, automatic horizontal sliding doors, or automatic swinging doors (i.e. doors that swing open and shut on hinges) may be employed.

It will be understood that various changes in the details, materials, and arrangements of the parts which have been described and illustrated above in order to explain the nature of this invention may be made by those skilled in the art without departing from the principle and scope of the invention as recited in the following claims.

What is claimed is:

1. An apparatus for filling drums with a substance, the apparatus comprising:

(a) first and second external chambers;

(b) an interior filling chamber adjacent to said first and second external chambers; and (c) a first exterior door between the first external chamber and an outside environment, a second exterior door between the second external chamber and the outside environment, a first interior door between the first external chamber and the filling chamber, and a second interior door between the second external chamber and the filling chamber, wherein the filling chamber comprises means for filling a drum with the substance and means for venting out of the filling chamber gaseous emissions produced during said filling.

2. The apparatus of claim 1, wherein:

the filling chamber comprises a lance for being lowered into a bunghole of a drum and for filling said drum with the substance;

the first external chamber is an orientation chamber comprising means for orienting a non-oriented drum so that the bunghole is positioned to receive the lance after the drum is indexed into the filling chamber; and the second external chamber is a capping chamber in which the bunghole of the drum is capped.

3. The apparatus of claim 2, wherein the capping chamber comprises a manual opening through which a human operator may manually cap a bunghole of a filled drum.

4. The apparatus of claim 2, wherein a drum filling cycle comprises the following sequential stages:

(1) the second exterior door is opened while the second interior door closed, to allow a capped drum to be delivered from the capping chamber, (2) the second exterior door is closed;

(3) the first and second interior doors are opened, while the first and second exterior doors are closed, to allow a filled drum to be indexed into the capping chamber and to allow an oriented drum to be indexed from the orientation chamber into the filling chamber;

(4) the first and second interior doors are closed;

(5) the first exterior door is opened, while the first interior door is closed, to allow a non-oriented, empty drum to be indexed into the orientation chamber; and (6) the first exterior door is closed.

5. The apparatus of claim 1, wherein the first and second interior doors and the first and second exterior doors are automatic, vertical sliding doors.

6. The apparatus of claim 1, further comprising means for controlling the opening and closing of the interior and exterior doors during a drum filling cycle such that the first interior door and the first exterior door are never open simultaneously and the second interior door and the second exterior door are never open simultaneously.

7. The apparatus of claim 1, further comprising a first louver between the first external chamber and the filling chamber and a second louver between the second external chamber and the filling chamber, for controlling the amount of limited air flow communication between the filling chamber and the first and second external chambers, respectively.

8. The apparatus of claim 1, further comprising a conveyor for selectively indexing drums into the first external chamber, from the first external chamber into the filling chamber, from the filling chamber into the second external chamber, and out of the second external chamber.

9. The apparatus of claim 1, wherein:

the filling chamber comprises a lance for being lowered into a bunghole of a drum and for filling said drum with the substance;

the first external chamber provides a wait stage; and the second external chamber further comprises a glove box through which a human operator may manually orient a non-oriented drum so that the bunghole is positioned to receive the lance.

10. The apparatus of claim 1, wherein:

there is no substantial air pressure communication between the first and second external chambers and the outside environment, respectively, when the first and second exterior doors, respectively, are closed;

there is no substantial air pressure communication between the first and second external chambers and the filling chamber when the first and second interior doors, respectively, are closed; whereby there is no substantial air pressure communication between the filling chamber and the outside environment when (1) at least one of the first interior door and the first exterior door is closed and (2) at least one of the second interior door and the second exterior door is closed; and during a drum filling cycle, the first interior door and the first exterior door are never open simultaneously, and the second interior door and the second exterior door are never open simultaneously so that there is no substantial air pressure communication between the filling chamber and the outside environment during the drum filling cycle.

11. The apparatus of claim 10, wherein because of the lack of substantial air pressure communication between the filling chamber and the outside environment during the drum filling cycle, the venting means has a lower air flow capacity than would be required if there were substantial air pressure communication between the filling chamber and the outside environment during the drum filling cycle.

12. The apparatus of claim 11, wherein the venting means comprises a blower large enough to vent out of the filling chamber gaseous emissions produced during the drum filling cycle but smaller than a second blower which would be required if the filling chamber were open to the outside environment for at least part of the drum filling cycle.

13. The apparatus of claim 1, wherein the venting means comprises a blower.

14. A method for filling drums with a substance, the method comprising the steps of:

(a) providing first and second external chambers;

(b) providing an interior filling chamber adjacent to said first and second external chambers;

(c) providing a first exterior door between the first external chamber and an outside environment, a second exterior door between the second external chamber and the outside environment, a first interior door between the first external chamber and the filling chamber, and a second interior door between the second external chamber and the filling chamber; and (d) filling in the filling chamber a drum with the substance and venting out of the filling chamber gaseous emissions produced during said filling.

15. The method of claim 14, further comprising the steps of:

(e) indexing the drum into the first external chamber, into the filling chamber for said filling of step (d), and into the second external chamber; and (f) controlling the opening and closing of the interior and exterior doors during said indexing such that the first interior door and the first exterior door are never open simultaneously and the second interior door and the second exterior door are never open simultaneously.

16. The method of claim 15, wherein step (f) comprises a drum filling cycle comprising the following sequential stages:

(1) the second exterior door is opened while the second interior door is closed, to allow a capped drum to be delivered from the capping chamber, (2) the second exterior door is closed;

(3) the first and second interior doors are opened, while the first and second exterior doors are closed, to allow a filled drum to be indexed into the capping chamber and to allow an oriented drum to be indexed from the orientation chamber into the filling chamber;

(4) the first and second interior doors are closed;

(5) the first exterior door is opened, while the first interior door is closed, to allow a non-oriented, empty drum to be indexed into the orientation chamber; and (6) the first exterior door is closed.

17. The method of claim 14, wherein:

there is no substantial air pressure communication between the first and second external chambers and the outside environment, respectively, when the first and second exterior doors, respectively, are closed;

there is no substantial air pressure communication between the first and second external chambers and the filling chamber when the first and second interior doors, respectively, are closed; whereby there is no substantial air pressure communication between the filling chamber and the outside environment when (1) at least one of the first interior door and the first exterior door is closed and (2) at least one of the second interior door and the second exterior door is closed; and during a drum filling cycle, the first interior door and the first exterior door are never open simultaneously, and the second interior door and the second exterior door are never open simultaneously so that there is no substantial air pressure communication between the filling chamber and the outside environment during the drum filling cycle.

18. The method of claim 17, wherein a blower in the filling chamber is used to vent gaseous emissions out of the filling chamber and, because of the lack of substantial air pressure communication between the filling chamber and the outside environment during the drum filling cycle, the blower has a lower air flow capacity than would be required if there were substantial air pressure communication between the filling chamber and the outside environment during the drum filling cycle.

19. The method of claim 18, wherein the blower is large enough to vent out of the filling chamber the gaseous emissions during the drum filling cycle but smaller than a second blower which would be required if the filling chamber were open to the outside environment for at least part of the drum filling cycle.

* * * * *